United States Patent [19]

Haller et al.

[11] Patent Number: 4,848,131

[45] Date of Patent: Jul. 18, 1989

[54] CRIMPING APPARATUS

[75] Inventors: Melita A. Haller, Endwell; David J. Klossner, Binghamton, both of N.Y.

[73] Assignee: International Business Machines Corp., Armonk, N.Y.

[21] Appl. No.: 114,350

[22] Filed: Oct. 27, 1987

[51] Int. Cl.[4] ..... B21D 22/06

[52] U.S. Cl. ..... 72/399; 72/452

[58] Field of Search ..... 72/399, 416, 452

[56] References Cited

U.S. PATENT DOCUMENTS

| | | | |
|---|---|---|---|
| 3,398,567 | 8/1968 | Olsson | 72/416 |
| 3,728,888 | 4/1973 | Motzer | 72/416 |
| 4,339,940 | 7/1982 | MacKay et al. | 72/452 |

FOREIGN PATENT DOCUMENTS

| | | | |
|---|---|---|---|
| 936769 | 9/1963 | United Kingdom | 72/452 |

*Primary Examiner*—Lowell A. Larson

*Attorney, Agent, or Firm*—Paul M. Brannen

[57] ABSTRACT

A crimping apparatus has, at each crimp location, a pair of opposing crimping jaws, which, when driven closed, crimp a pin located between the jaws. The jaws are driven open and closed by a sliding drive member having two grooves therein, one on each side of the centerline joining the center of the closed jaws and the center of the drive member. The grooves are at an angle with respect to the line joining the center of the closed jaws and the center of the drive member. The jaws are each provided with a projection which is engaged in the associated groove in the drive member, whereby when the drive member is reciprocated toward and away from the jaws, the camming action of the grooves and projections on the jaws causes the jaws to close and open, respectively. The camming angles are equal, thus causing the jaws to move to their closed and open positions in equal increments of motion. The camming angles are further selected to be equal to twenty-two and one-half degrees, thus eliminating the possibility of jamming, which could occur if larger angles were used. Transmission of force from the drive member to the location of the work load is substantially in line, reducing any tendency toward buckling.

7 Claims, 5 Drawing Sheets

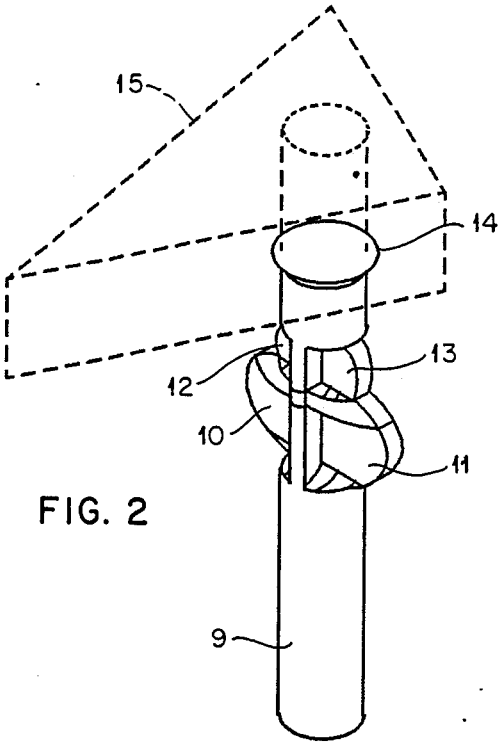
FIG. 2
FIG. 4A
PRIOR ART
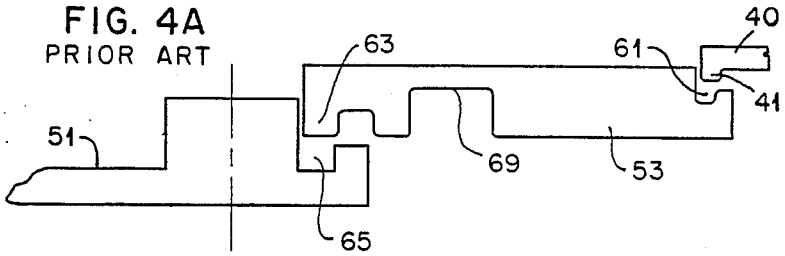
FIG. 4B
PRIOR ART
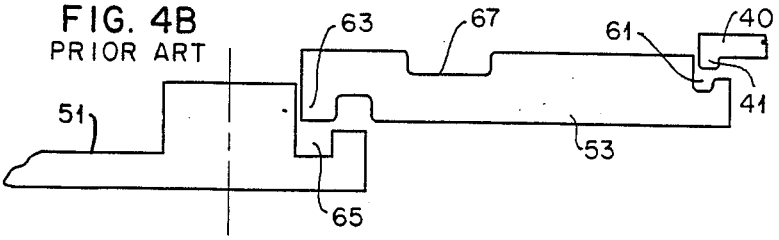

CRIMPING APPARATUS

BACKGROUND OF THE INVENTION

1. Field of the Invention

This invention relates to crimping apparatus and particularly to crimping apparatus for crimping or swageing selected pins of a microcircuit module to form a flattened portion of the pin intermediate its length, thereby providing a standoff for mounting the module at a predetermined distance from a printed circuit card or other module support means.

2. Description of the Prior Art

A known type of crimping apparatus to be subsequently described in detail and which is illustrated in the accompanying drawings, includes a plurality of crimping jaws operated by orthogonally located slides and arranged to close on selected pins extending from a microcircuit module, and to form swaged or crimped portions of the pins, commonly known as "butterflies" or "butterfly wings". The jaws are driven by relatively slender arms on either side of a slide member, and the parts are provided on two crisscross levels so that a first and second lower pair of arms drive two sets of jaws and a third and fourth upper pair of arms drive two sets of jaws. These parts are subject to wear and adjustments for wear, including driving the jaws beyond contact to compensate for a sloppy fit between the arms and slides, will ultimately cause buckling of the arms and fatigue failure. Buckling is also caused by the fact that the driving force is transmitted along a line of motion below the level at which the work (crimp) is done. The parts are difficult to adjust for lost motion and wear.

OBJECTS OF THE INVENTION

Accordingly, it is a principal object of the invention to provide an improved crimping apparatus, which relieves problems of wear and adjustment.

Another object of the invention is to provide an improved crimping apparatus including improved means for driving the crimping jaws.

A further object of the invention is to provide an improved crimping apparatus in which the driving members which drive the actual crimping jaws are simple and rugged in design.

Yet another object of the invention is to provide an improved crimping apparatus which has only a few moving parts in comparison with known mechanisms, thereby reducing problems due to lost motion and wear.

Still another object of the invention is to provide an improved crimping apparatus which includes a simple method of adjustment to compensate for lost motion and wear of the moving parts.

A further object of the invention is to provide an improved crimping apparatus having pairs of opposing crimping jaws which are closed upon a pin to be crimped by the camming action of a slide member upon such pair of jaws.

Another object of the invention is to provide an improved crimping apparatus having pairs of opposing crimping jaws which are closed upon a pin to be crimped by camming action of angularly related operating faces on sliding members carrying the said jaws, and a driving member having angularly related operating faces engaging the operating faces of the sliding members.

Yet another object of the invention is to provide an improved crimping apparatus in which plural pairs of crimping jaws are driven to a crimping condition by forces transmitted from a common driving means via angularly related sliding members.

Still another object of the invention is to provide an improved crimping apparatus in which plural pairs of crimping jaws are driven by sliding motion between angularly disposed sliding drive members driven by a corresponding plurality of angularly disposed surfaces on a common driving member angularly positioned to impart driving motion to said jaws.

Another object of the invention is to provide an improved crimping apparatus of the type described.

Another object of the invention is to provide a direct line of force from the driving member to the worklevel.

SUMMARY OF THE INVENTION

The present invention provides an improved crimping apparatus for forming a crimp in the corner pins of a pinned substrate as used in microcircuit applications. The crimping forms a butterfly-shaped standoff configuration in the four corner pins of the ceramic substrate, so that the subsequent fastening of the substrate to a circuit board, as by soldering, will provide a predetermined spacing between the substrate and the circuit board. A plurality of pairs of crimping jaws are provided, each pair arranged so that when driven closed, a pin within a pair of jaws has an appropriate crimp imparted thereto. Each pair of jaws has slots or grooves therein, angularly related to the direction of motion of the jaws. A common drive member having guiding grooves or slots therein which engage the slots of the jaws is provided, the parts being proportioned and arranged so that motion of the common drive member in a direction perpendicular to the direction of jaw motion will close or open the jaws. The common drive member is driven by a block mounted on an eccentric pin, which is rotated by a pinion of a planetary gear drive. The blocks are proportioned and arranged to have driving faces with different dimensions from the eccentric to the faces of the block, whereby the relation of the driver blocks and the associated common drive member may be adjusted by appropriate rotation of the block, thus compensating for wear and lost motion in the mechanism.

BRIEF DESCRIPTION OF THE DRAWINGS

The foregoing objects and other features of the invention and its advantages will become more fully understood from the following detailed description when considered with the accompanying drawings in which;

FIG. 2 is a diagrammatic view of a module pin having a butterfly crimp of the type produced by the prior art and the present invention.

FIG. 4A is a diagrammatic elevational view of an upper drive arm assembly.

FIG. 4B is a diagrammatic elevational view of a lower drive arm assembly. These drive arm assemblies are of the type used in the mechanism shown in FIG. 3.

Similar reference characters refer to similar parts in each of the several views.

DETAILED DESCRIPTION OF THE DRAWINGS

Figure 1:
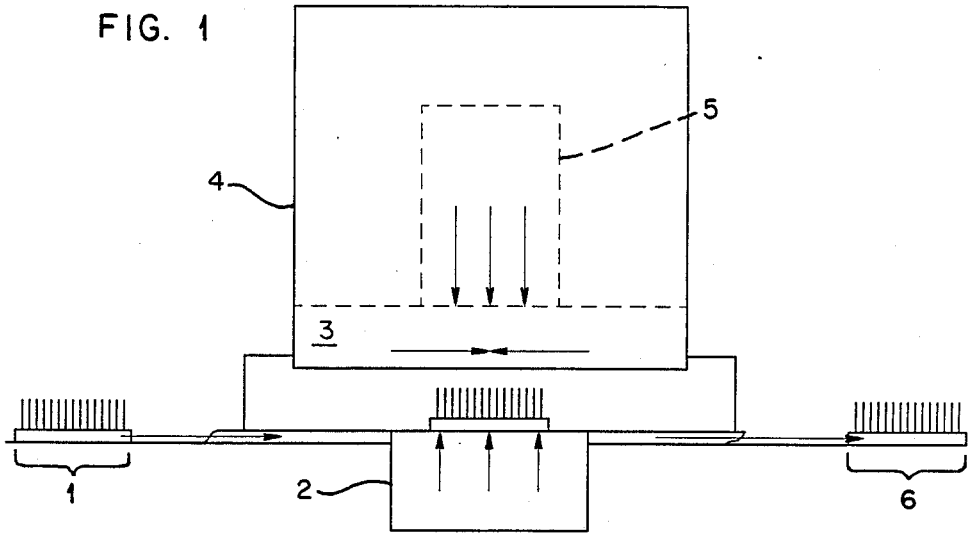
FIG. 1 is a schematic diagram of a crimping station in a microcircuit module production line.

Referring to FIG. 1 of the drawings, there is shown in diagrammatic form the arrangement of a crimping station in a microcircuit production line in which each of the microcircuit modules is processed to crimp the four corner pins in the module with butterfly crimps, to thereby provide a standoff arrangement in which the microcircuit module will be held at an appropriate spacing from an associated mounting device. The previously known mechanism as well as the new mechanism constituting this invention are employed at the swageing or crimping station to form the crimps in the modules as they pass through the line including the crimping station.

The crimping station includes an input location 1 to which the modules are supplied, pins up, in serial fashion. The modules are moved to the insert mechanism 2, which then proceeds to insert the module into the crimping mechanism 3 which includes a crimp head 4 including a knock out mechanism 5, which, after the crimping operation has taken place, removes the crimped module and this finished product is then moved through the station to the output location 6. The knock out mechanism, insert mechanism and the like are not shown or described, since they form no part of the present invention.

FIG. 2 shows a diagrammatic isometric view of a pin having a crimped or swaged portion as provided by operation of both the prior art mechanism and the mechanism of the present invention. The pin 9 is formed of a suitable malleable material such as brass of appropriate hardness, and the swaged or crimped portions resemble the wings of a butterfly hence the name "butterfly" crimp. The crimp portions comprise two outwardly extending main wings 10 and 11, and two minor wings above the major wings, bearing reference characters 12 and 13. Located a predetermined distance above the crimps is a shoulder portion 14, which engages the lower side of the substrate 15 shown by dotted lines. The upper end of the pin extends through the substrate and is soldered or otherwise affixed thereto. It will be apparent from the consideration of the relation of the parts that when the substrate with the crimped pins is attached to a supporting element such as a printed circuit board, the crimped portions will only allow the main body of pin 9 to penetrate the supporting surface to a predetermined amount, so that a consistent clearance is provided between the bottom of substrate 15 and the upper surface of the supporting element.

Figure 3:
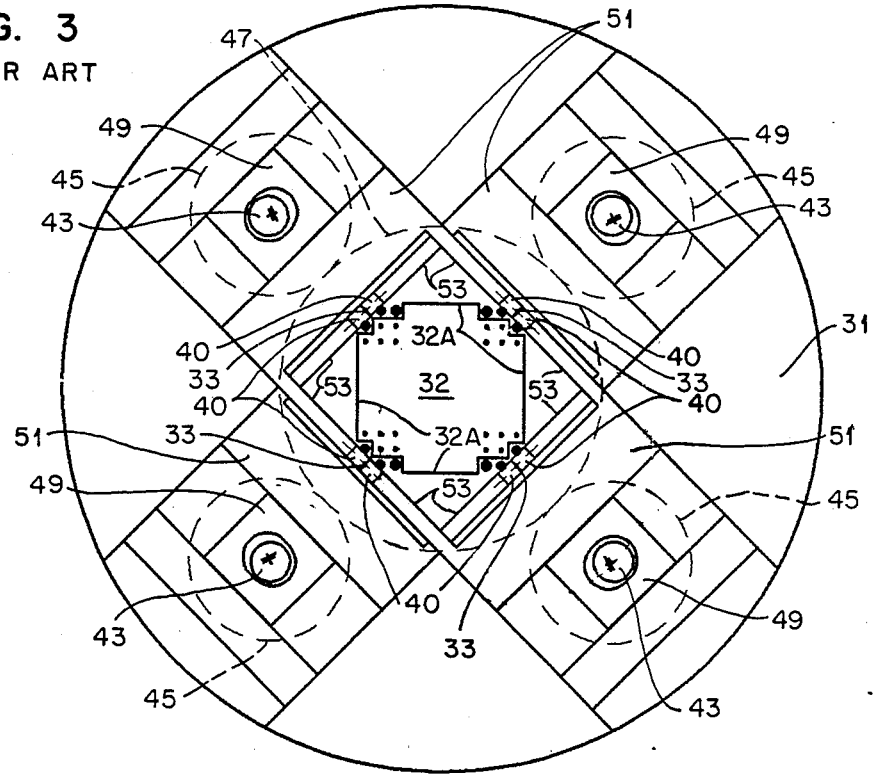
FIG. 3 PRIOR ART
FIG. 3 is a diagrammatic plan view of a prior art crimping mechanism.

FIG. 3 is a plan view of the operating area of a prior art crimping mechanism, which mechanism constitutes the best known prior art of which applicants are presently aware. The mechanism consists of a base plate 31 that has a central rectangular like opening or recess 32 with step like opposite symmetrical sides 32A. Adjacent to each of the four corners of opening 32 is a pin opening 33 provided in the plate 31, each opening 33 receiving one of the corresponding four corner pins of the substrate to be crimped.

Insertion of the pins into the openings in plate 31, including the openings 33 is accomplished by motion of the insert mechanism toward the fixed head containing the crimping mechanism. Four sets or pairs of crimping jaws 40 are provided, each jaw having an appropriate groove or recess cut in its end so that when associated jaws are closed or brought together around one of the locator pins, the pressure exerted by the jaws will form the butterfly crimp. Each set of jaws is driven by sliding drive arms and it is considered that the description of one set of driving mechanism will suffice, since the four driving arrangements have similar parts and are symmetrically arranged, taking note that one set of driving arms is located over the other set. That is to say, there are upper and lower driving arms or members and their associated drive pieces criss-crossed so as to accommodate all four sets. A plurality of eccentric pins 43 are rotated by associated pinions 45, indicated by the dashed line circles arranged in planetary fashion around a main driving gear 47 also indicated by a dashed line circle. When the main driving gear 47 is rotated, all of the eccentric pins will also be rotated simultaneously, so that a synchronized operating cycle of the mechanism is provided. The eccentric pins rotate within an opening in a drive block 49, so that as a result the drive blocks 49 are reciprocated toward and away from the recess 32 in the base plate. Each of the reciprocating drive blocks 49 engages the sides of a groove in a drive member 51, so that the drive member 51 is also reciprocated toward and away from the opening 32 in correspondence with the operation of the block 49 and the eccentric pin.

Thus far it will be seen that a reciprocating motion is provided in each of the four jaw driving arrangements of the crimping mechanism so that the associated locator pins in the openings 33 will be crimped by jaws driven by this mechanism as thus far described. Each of the sliding members 51 is provided with a pair of drive arms 53, one on either side, which in turn operate the jaws 40. The upper set of drive mechanisms drives two sets of arms 53, which drive the sets of jaws 40 associated therewith. Beneath the upper level of the mechanism is the lower level of drive members and arms which drive the two other sets of jaws 40. The arms 53 are suitably notched to engage the associated drive members 51 and the associated jaws 40 so that reciprocation of the members 51 will also reciprocate the arms 53 and the associated jaws 40.

FIGS. 4A and 4B are diagrammatical views of the upper and lower arm assemblies of the prior art mechanism as shown in the plan view of FIG. 3. The jaws 40 are provided with an offset 41 which engages a notch 61 in the associated arm 53 so that as the arm is reciprocated the jaw connected thereto will be operated accordingly. Similarly he arms have offsets 63 which engage notches 65 in the slide members 51 and thus couple the arm to the slide members for reciprocating action. It will be noted that the lower arm has a notch or recess 67 in the upper surface thereof and the upper arm has a similar but deeper recess 69 in the lower surface. This permits the arms to be criss-crossed in the manner shown in FIG. 3, to permit the required reciprocating motion of the arms on the two different levels.

Although this arrangement operates in a satisfactory manner, the parts are subject to considerable wear and, because the arms 53 must of necessity be relatively small in cross section, the continued wear will eventually reach the point where the compensation required to take up lost motion produces excessive stress in the arms themselves so that there is a tendency for them to buckle and/or break. Also it is difficult to adjust the jaws which operate on any given pin because these jaws are driven by two separate sliding assemblies and both assemblies require adjustment in order to properly compensate for a jaw wear. It is these disadvantages that led to the conception of the present invention where the mechanism can be of more robust construction and which is arranged so that one adjustment will serve to adjust both jaws acting on any given pin.

Figure 5A:
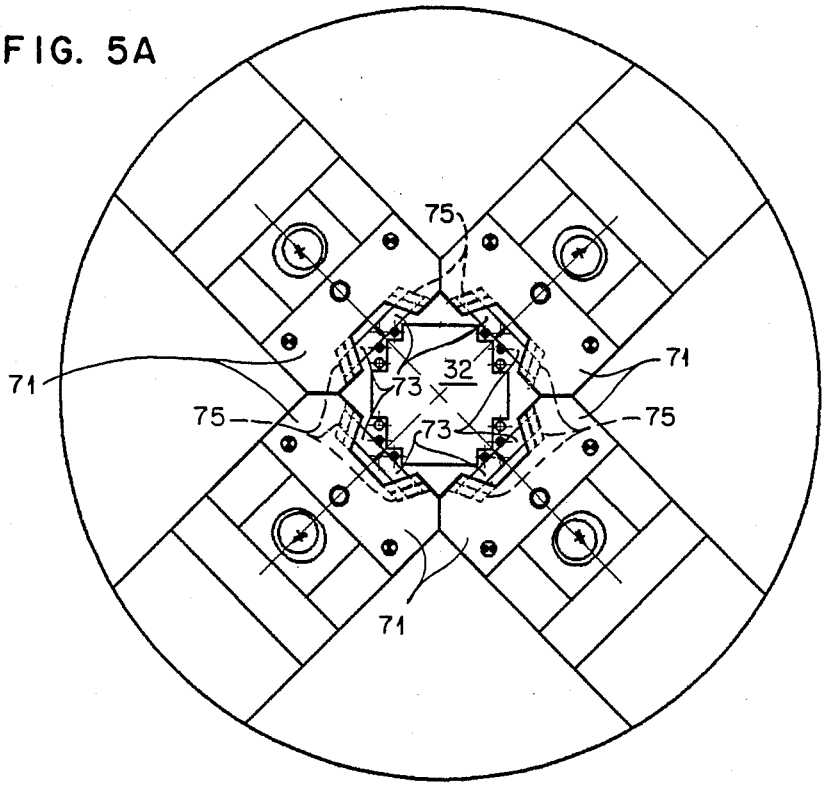
FIG. 5A is a diagrammatic plan view of an improved crimping apparatus in accordance with a preferred embodiment of the present invention.
Figure 5B:
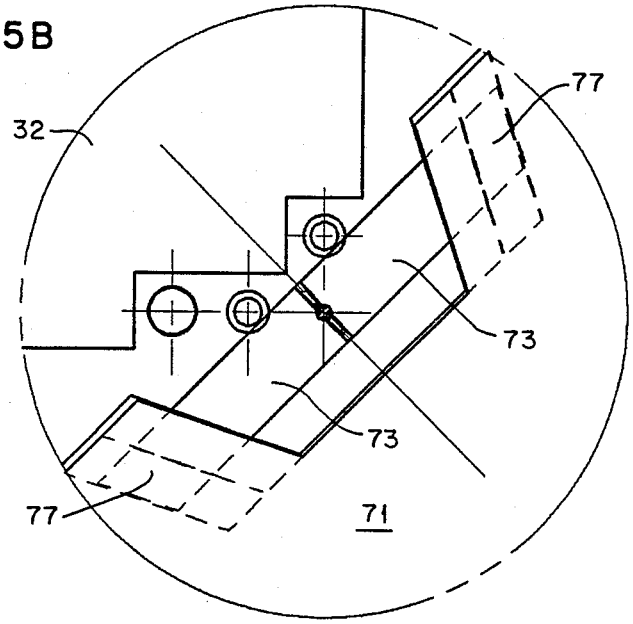
FIG. 5B is a diagrammatic enlarged plan view of a portion of FIG. 5A.

FIGS. 5A and 5B are plan views of the improved crimping mechanism in accordance with a preferred embodiment of the present invention. It will be apparent from an examination of these two figures that the basic drive mechanism remains unchanged from that described in connection with the prior art mechanism shown in the plan view of FIG. 3. The planetary gear system, the eccentric pins and the drive blocks are essentially the same as used in the prior art system. However, several important and different features should be particularly noted.

First, a single drive member 71 is supplied for each of the four pairs of jaws. The drive member is a two piece construction and arranged to be reciprocated by the drive block as shown.

Second, each of these drive members drives one pair of jaws 73, utilizing angularly positioned slots 75 in the drive member and angularly positioned extensions or projections 77 on the jaws themselves. These parts are meshed, and the relationship seen in FIGS. 5A and 5B is such that motion of a drive member 71 toward the recess will cause the associated pair of jaws 73 to close, and motion away from the recess will act upon the jaws in such manner as to open them. The angles of the meshing parts are at 22½ degrees with respect to the center lines of the closed jaws and the drive member, and this provides a suitable closing operation without the possibility of the parts jamming or sticking which could occur if the engaging angles were greater than 22½ degrees.

Third, the drive member and the jaws are proportioned and arranged so that the driving force is transmitted substantially in line with the work load (crimp) thus greatly reducing any tendency toward buckling of the parts.

It can be seen that with this new arrangement the nesting or criss-crossing of the parts required in the prior art arrangement is unnecessary, since all of the parts can operate in the same plane and there is no necessity for the criss-cross arrangement used in the prior mechanism. As a result, the weaknesses caused by the provision of the notched portions of the operating arms in the prior art mechanism is eliminated and the parts can be of more rugged design and thus less subject to wear or possible breakage.

Figure 6A:
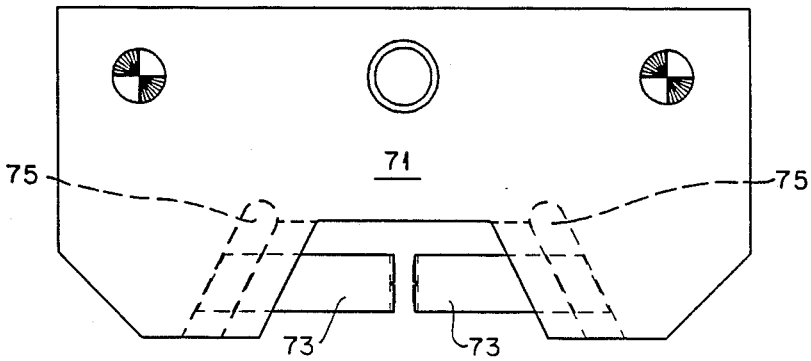
FIG. 6A is a diagrammatic enlarged plan view of the crimping jaws and drive mechanism of the arrangement of FIGS. 5A and 5B.

FIGA. 6A and 6B are diagrammatic plan and elevational views of the crimping jaws and the drive member as found at each of the four crimping locations in the embodiment according to the present invention. FIG. 6A shows an enlarged plan view of the crimping jaws 73 and the drive member 71, and as can be seen each of the crimping jaws engages a recess or groove in the driving member which is at an angle of 22½ degrees with respect to the mid line of the jaws and the driving member. It will be apparent from the illustration in FIG. 6A that as the drive member is moved in a downward direction as viewed in the drawing, a force will be exerted on the crimping jaws to move them toward each other in equal increments of motion.

Figure 6B:
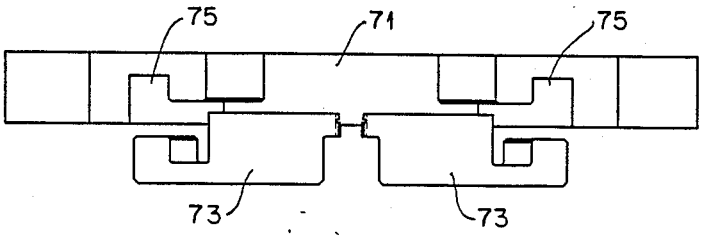
FIG. 6B is a diagrammatic exploded isometric view of the arrangement shown in FIG. 6A.

Conversely when the driving member is moved in an upward direction as seen in the drawing, the force on the crimping jaws will be such as to open them and draw them apart by equal increments. The relationship of the jaws to the driving member is also shown in the exploded isometric elevational view of FIG. 6B and it is apparent that consideration of these two drawings in conjunction with each other adequately illustrates the operation and the novel features of the present invention.

Figure 7:
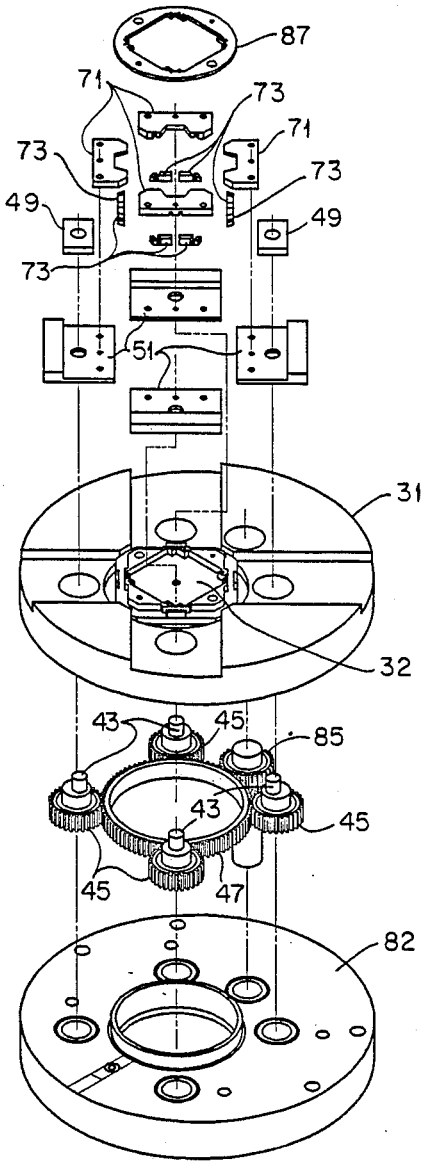
FIG. 7 is a diagrammatic exploded view of the entire assembly of the crimping mechanism according to the preferred embodiment of the present invention.

FIG. 7 is a diagrammatic exploded view of the entire assembly of the new crimping mechanism according to the preferred embodiment of the invention.

In this drawing, moving from the bottom upward, there is shown the base plate 82 of the mechanism, on which are mounted the planetary or ring gear 47 together with the four pinions 45 which drive the eccentric pins. A driving pinion 85 is also shown by which rotation is imparted to the ring gear and the associated pinions and eccentrics. Next is shown the bottom plate 31 of the crimping mechanism which has a recess 32 and the grooved guide portions for the drive members and the jaws. The drive members for each of the four operating positions are shown as well as the driving blocks 49 which are driven by the eccentric pins 43. At the top of the drawing is shown the driving members 71 together with the crimping jaws for each of the locations, and finally there is shown a cap or retaining disk 85 which retains all the parts in their operative positions.

As previously pointed out, the driving blocks 49 are designed to have the operating faces thereof located at different distances from the driving pin, so that the stroke of the drive member 71 can be adjusted in increments, to thereby compensate for wear in the mechanism.

From all of the foregoing, it will be apparent that our invention provides a new and improved crimping apparatus which is much simpler and sturdier than previously known apparatus, and is not subject to as many difficulties as the former apparatus with respect to problems of lost motion and wear, achieved by having fewer and more sturdy parts than the known apparatus.

Although we have herein shown and described only one preferred embodiment of our invention, it will be apparent to those skilled in the art to which the invention appertains, that various other changes and modifications may be made to the subject invention, without departing from the spirit and scope thereof, and therefore it is understood that all modifications, variations and equivalents within the spirit and scope of the subject invention are herein meant to be encompassed in the appended claims.

Having thus shown and described our invention, what we claim is:

1. Crimping apparatus for crimping a malleable pin, comprising, in combination, a slideable drive member reciprocally movable along a first linear axis, first and second crimping jaws reciprocally movable along a second axis perpendicular to said first axis, said jaws having projections thereon aligned with third and fourth axes disposed at converging equal angles with respect to said first axis, said drive member having projections which engage the projections on said first and second jaws, driving means for cyclically reciprocating said slideable drive member along said first linear axis, said driving means comprising an eccentric pin rotated by a planetary gear system, whereby in response to the movement of said slideable drive member toward said jaws, the jaws are driven toward each other, and in response to the movement of said slideable drive member away from said jaws, the jaws are retracted from each other.

2. Crimping apparatus as claimed in claim 1, further characterized by including a driving block reciprocated by said eccentric pin, and driving said slideable drive member in each direction in response to the rotation of eccentric pin.

3. Crimping apparatus as claimed in claim 2, further characterized by said driving block having a plurality of operating faces having different distances from said eccentric pin to the operating faces of said block, whereby the stroke of said drive member can be changed by predetermined increments.

4. Crimping apparatus as claimed in claim 1, further characterized by a base plate carrying the slideable drive member and the crimping jaws in grooves in the base plate.

5. Crimping apparatus as claimed in claim 1, further characterized by a plurality of said drive members and a corresponding plurality of pairs of said crimping jaws associated with said drive members simultaneously to provide a plurality of simultaneous crimping operations.

6. Crimping apparatus as claimed in claim 1, further characterized by said crimping jaws having a relatively high ratio of cross-sectional area to length.

7. Crimping apparatus as claimed in claim 1, further characterized by said converging equal angles having a value of twenty-two and one-half degrees.

* * * * *